US006358131B1

(12) United States Patent
Sakurai et al.

(10) Patent No.: US 6,358,131 B1
(45) Date of Patent: Mar. 19, 2002

(54) POLISHING APPARATUS

(75) Inventors: Kunihiko Sakurai; Satoshi Wakabayashi; Tetsuji Togawa, all of Kanagawa-ken (JP)

(73) Assignee: Ebara Corporation, Tokyo (JP)

( * ) Notice: Subject to any disclaimer, the term of this patent is extended or adjusted under 35 U.S.C. 154(b) by 36 days.

(21) Appl. No.: 09/625,490

(22) Filed: Jul. 25, 2000

(30) Foreign Application Priority Data

Jul. 26, 1999 (JP) ..... 11-210949

(51) Int. Cl.[7] ..... B24B 5/00; B24B 29/00

(52) U.S. Cl. ..... 451/287; 451/285

(58) Field of Search ..... 451/28, 41, 57, 451/63, 65, 285, 287, 288, 289, 397, 398

(56) References Cited

U.S. PATENT DOCUMENTS

| | | | | |
|---|---|---|---|---|
| 5,329,732 A | | 7/1994 | Karlsrud et al. | |
| 5,333,413 A | * | 8/1994 | Hashimoto | 451/287 |
| 5,649,854 A | | 7/1997 | Gill, Jr. | |
| 5,655,954 A | * | 8/1997 | Oishi et al. | 451/287 |
| 5,738,573 A | | 4/1998 | Yueh | |
| 5,908,347 A | * | 6/1999 | Nakajima et al. | 451/287 |
| 5,928,062 A | * | 7/1999 | Miller et al. | 451/287 |
| 5,989,107 A | * | 11/1999 | Shimizu et al. | 451/287 |

OTHER PUBLICATIONS

U.S. Patent Application Serial No. 09/518,958, "Polishing Apparatus", Filed Mar. 3, 2000.

U.S. Patent Application Serial No. 09/341,882, "Polishing Apparatus", Filed Jul. 20, 2000.

* cited by examiner

*Primary Examiner*—Derris H. Banks
(74) *Attorney, Agent, or Firm*—Wenderoth, Lind & Ponack, L.L.P.

(57) ABSTRACT

The present invention provides a polishing apparatus comprising a polishing table having a polishing surface, a substrate carrier having an axis about which the substrate carrier is rotatable. The substrate carrier includes a plurality of substrate holders positioned around a circle about the axis of the substrate carrier and spaced apart from each other at equal angular distances, with each of the substrate holders being adapted to hold a substrate and bring it into contact with the polishing surface. The apparatus further comprises a substrate loading device laterally spaced apart from the polishing table, in which device a substrate is picked up by one of the substrate holders which is positioned at the substrate loading device, and a substrate unloading device laterally spaced apart from the polishing table, in which device one of the substrate holders which is positioned at the substrate unloading device releases a wafer onto the unloading device. The substrate carrier is indexably rotated about the stated axis in such a manner that one of the substrate holders is selectively positioned at the loading device, while another substrate holder is positioned at the unloading device and at least one of the other substrate holders is positioned over the polishing surface.

18 Claims, 5 Drawing Sheets

90°
-270°
12
15a
15b
15c
15d
19
20
21
P1
P2

POLISHING APPARATUS

BACKGROUND OF THE INVENTION

The present invention relates to a polishing apparatus for polishing a surface of a workpiece, such as a semiconductor wafer, to a high degree of fineness.

In a semiconductor device manufacturing process, a polishing apparatus is used to polish surfaces of semiconductor wafers. However, during polishing, particles become detached from the wafer and scattered around the polishing apparatus, and hence it has not been possible to use a conventional polishing apparatus in a clean room environment. In addition, in a conventional system, the wafer after polishing is placed in a mobile water tank for transportation to a cleaning apparatus, which is inefficient in terms of both the time and space required to complete a polishing and cleaning operation.

To solve the above-mentioned problems, a so-called dry-in/dry-out system has been developed in which polishing and cleaning processes are carried out in an apparatus enclosed within a housing. In the dry-in/dryout system, a semiconductor wafer is loaded into the apparatus in a dry state, and is unloaded in a dry state after polishing and cleaning.

Aside from the development of the dry-in/dry-out system, a polishing apparatus per se has been modified such that it is able to be used in a clean room. Further, improvements in the processing efficiencies of a polishing apparatus and a cleaning apparatus have enabled their installation in a space equal to or smaller than that required for the installation of a dry-in/dry-out system. However, there remains a difficulty in the automation of the wafer transportation means incorporating a mobile water tank.

SUMMARY OF THE INVENTION

An object of the present invention is to provide a polishing apparatus which is applicable to the above-described dry-in/dry-out polishing system, by use of which the efficiency of polishing workpieces such as semiconductors can be increased both in terms of the time required and space utilized.

According to the present invention, there is provided a polishing apparatus comprising a polishing table having a polishing surface, a substrate carrier having an axis about which the substrate carrier is rotatable. The substrate carrier includes a plurality of substrate holders positioned around a circle about the axis of the substrate carrier and spaced apart from each other at equal angular distances, with each of the carriers being adapted to hold a substrate and bring It into contact with the polishing surface. The apparatus further comprises a substrate loading device laterally spaced apart from the polishing table, in which device a substrate is picked up by one of the substrate holders which is positioned at the substrate loading device, and a substrate unloading device laterally spaced apart from the polishing table, in which device one of the substrate holders which is positioned at the substrate unloading device releases a wafer onto the unloading device. The substrate carrier is indexably rotated about the stated axis in such a manner that one of the substrate holders is selectively positioned at the loading device, while another substrate holder is positioned at the unloading device and at least one of the other substrate holders is positioned over the polishing surface.

In the present invention, polishing, loading and unloading of substrates with respect to the polishing table are simultaneously effected. Therefore, the number of substrates processed per unit time (throughput) can be remarkably increased.

The polishing apparatus may comprise a liquid spray nozzle for supplying a liquid spray to the substrate held by the substrate holder positioned at the loading device and/or the unloading device. In the polishing apparatus, when polishing is conducted for a prolonged period of time or when the apparatus is stopped for a long time due to an emergency stop, it is possible to prevent the substrate from becoming dry thus avoiding the problem of dust, by spraying a liquid over the substrate in a standby condition.

The polishing apparatus may comprise three of the substrate holders, and the substrate carrier may be indexably rotated about the axis of the polishing table in such a manner that one of the substrate holders is selectively positioned at the loading device, while another substrate holder is positioned at the unloading device and the other substrate holder is positioned over the polishing surface.

The polishing apparatus may comprises four of the substrate holders, and the substrate carrier is indexably rotated about the stated axis in such a manner that one of the substrate holders is selectively positioned at the loading device, while another substrate holder is positioned at the unloading device and the other two substrate holders are positioned over the polishing surface. In the apparatus, polishing is effected twice and, as a result, it becomes possible to increase a throughput, while securing a sufficient polishing time. The two polishing positions are secured on a single polishing table (turntable), to thereby reduce the size of the apparatus.

DETAILED DESCRIPTION OF THE INVENTION

Embodiments of the polishing apparatus according to the present invention will now be described below with reference to the accompanying drawings.

Figure 1:
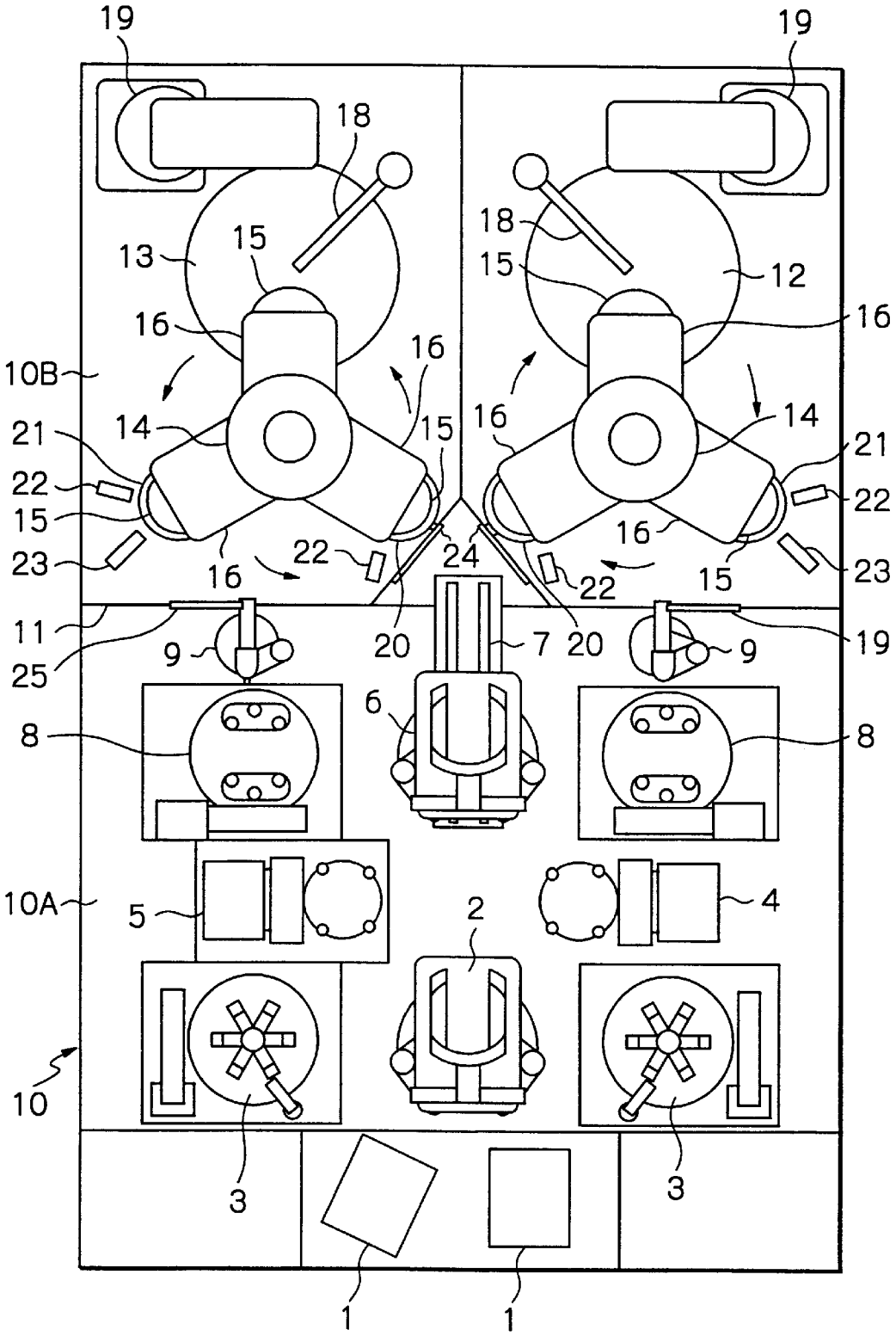
FIG. 1 is a plan view showing the arrangement of each part of a first embodiment of the polishing a according to the present invention.

FIG. 1 is a plan view of a first embodiment of a polishing apparatus according to the present invention.

The polishing apparatus shown in FIG. 1 has two rotatable loading/unloading stages 1 for placing wafer cassettes thereon. Each wafer cassette is stocked with a large number of semiconductor wafers. A transfer robot 2 having two hands is disposed at a position where the hands are able to reach the wafer cassettes on the loading/unloading stages 1.

Of the two hands of the transfer robot 2, one hand holds a clean semiconductor wafer, and the other hand holds only a contaminated wafer. Two cleaning machines 3 for cleaning and drying a polished semiconductor wafer are disposed on either side of the transfer robot 2 respectively, within reach of the hands of the transfer robot 2. Turning-over machines 4 and 5 for turning over a semiconductor wafer are disposed within reach of the hands of the transfer robot 2. The turning-over machines 4 and 5 are positioned in rotationally symmetric relation to the loading/unloading stages 1, with respect to the center of rotation of the transfer robot 2.

The turning-over machine 4 has a chucking mechanism for chucking a semiconductor wafer and a turning-over mechanism for turning a semiconductor wafer upside down. The turning-over machine 4 handles only clean semiconductor wafers, while the turning-over machine 5 includes a rinsing mechanism for washing semiconductor wafers, in addition to a chucking mechanism and a turning-over mechanism. The turning-over machine 5 handles only contaminated semiconductor wafers.

A transfer robot 6 provided with two hands is positioned in symmetric relation to the transfer robot 2, as viewed along a line passing through the centers of the semiconductor wafers handled by the turning-over machines 4 and 5. The transfer robot 6 travels along a rail 7 between a position where its hands can reach the turning-over machines 4 and 5 (rearmost position) and a position where its hands can reach below-mentioned loading lifts 20 (foremost position). Of the two hands of the transfer robot 6, one hand is employed for holding clean semiconductor wafers, while the other hand holds contaminated wafers.

Two cleaning machines 8 for cleaning a polished semiconductor wafer are disposed on either side of the transfer robot 6. The cleaning machines 8 are installed for access by the hands of the transfer robot 6. These cleaning machines 8 are different from the cleaning machines 3 in terms of the cleaning operation conducted thereby. Two transfer robots 9, each provided with one hand, are disposed at opposite sides of the transfer robot 6. The hands of the transfer robots 9 are designed to access the cleaning machines 8 and below-mentioned unloading lifts 21.

The entire polishing apparatus is housed in a housing 10 divided by a partition 11 into a cleaning chamber 10A and a polishing chamber 10B. The cleaning chamber 10A contains the transfer robots 6 and 9 and the other above-stated devices except for the loading lift 20 and the unloading lift 21. The partition 11 is disposed near the transfer robots 9 and the foremost position of the transfer robot 6.

Two polishing tables 12 and 13 each comprising a turntable are provided in the polishing chamber 10B. Rotatable wafer carriers 14 are provided at a side of the polishing tables 12 and 13. Three arms 16 extend radially relative to the axis of rotation of the wafer carrier 14. Each wafer carrier 14 supports a wafer holder 15 at a free end portion thereof so that the wafer holders 15 are positioned around a circle about the axis of the wafer carrier 14 and spaced apart from each other at equal angular distances, i.e., 120°. The wafer carrier 14 is indexably rotated about the axis thereof in accordance with the angular distances between the wafer holders 15. That is, the wafer carrier 14 is operated to intermittently rotate, stopping after a rotation of 1200 has been completed.

Figure 2:
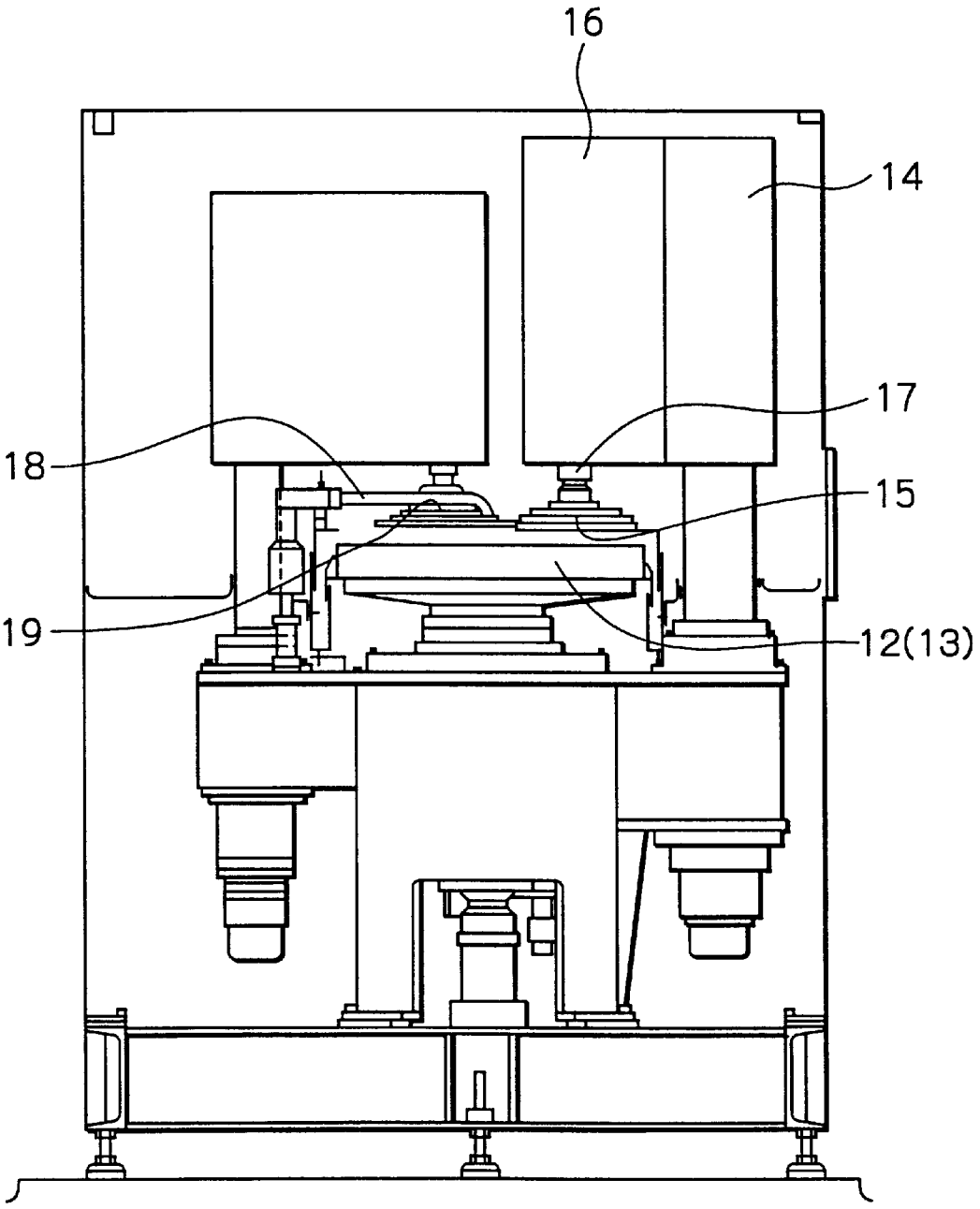
FIG.2 shows the relationship between a wafer holder and a polishing table in the apparatus of FIG. 1.

FIG. 2 shows the relationship between the wafer holder 15 and the polishing table 12 or 13. As shown in FIG. 2, the wafer holder 15 is suspended from the arm 16 through a rotatable shaft 17 and can access the polishing table. A pneumatic cylinder provided in the arm 16 is operated to urge a semiconductor wafer held on the wafer holder 15 against the polishing table under a desired load. A polishing liquid nozzle 18 for supplying a polishing liquid is disposed above the polishing table, so as to have an opening thereof positioned above a central portion of the polishing table. A dresser 19 is disposed for dressing the polishing table. The polishing table has a polishing cloth or abrasive plate fitted to the upper surface thereof to provide a polishing surface.

When one of the three wafer holders 15 is halted above the polishing table in the polishing chamber 10B, another wafer holder 15 which is positioned upstream of the one wafer holder 15 as viewed in a rotation direction of the wafer carrier 14 is located above the loading lift 20. In this instance, the remaining wafer holder 15 which is positioned downstream of the one substrate holder 15 as viewed in the rotation direction of the wafer carrier 14 is located above the unloading lift 21.

The loading lift 20 is vertically movable between a position where a semiconductor wafer is received from the robot 6 and a position where the loading lift 20 transfers the wafer to the wafer holder 15 positioned above the loading lift 20. The loading lift 20 has an automatic centering mechanism. An upward movement range of the loading lift 20 is determined such as to take account of any error in attachment of the wafer holder 15. The loading lift 20 is capable of transferring the wafer while holding the wafer holder 15. Further, the loading lift 20 includes a liquid spray nozzle 22. The liquid spray nozzle 22 sprays a liquid toward the wafer which is held by the wafer holder 15, to thereby prevent the wafer from becoming dry.

As in the case of the loading lift 20, the unloading lift 21 has the lifting mechanism, the automatic centering mechanism and the liquid spray nozzle 22. Further, the unloading lift 21 has a rinsing nozzle 23 for cleaning the wafer holder 15 after the wafer is released therefrom and the wafer released.

In this embodiment, each of the loading lift 20 and the unloading lift 21 includes the liquid spray nozzle 22. However, the rinsing nozzle 23 may serve as the liquid spray nozzle. Further, the liquid spray nozzle may be provided at a position opposite to the wafer holder 15 of the wafer carrier 14.

Opening portions are provided in the partition 11 between the loading lifts 20 and the transfer robot 6. Each opening portion is dimensioned so as to allow passage of the wafer therethrough. Shutters 24 are provided in the opening portions. Opening portions are also provided in the partition 11 between the unloading lifts 21 and the transfer robots 9 so as to allow passage of the wafer therethrough. Shutters 25 are provided in these opening portions.

An operation of the entire polishing apparatus arranged as stated above will be described below.

Semiconductor wafers to be polished are placed in the wafer cassettes. The wafer cassettes are placed on the loading/unloading stages 1. Following input of data corresponding to processing conditions, the apparatus starts an automated operation as stated below. In the polishing apparatus of the present invention, various polishing operations are possible. In the operation which is explained below, odd-numbered wafers counted from the uppermost slot of the wafer cassette are subjected to polishing on the polishing table 12 and even-numbered wafers are polished on the polishing table 13. Hereinbelow, steps 1 to 26 for polishing are explained.

1. The angle of the loading/unloading stage 1 is adjusted so that the hands of the transfer robot 2 can reach the stage 1.
2. The transfer robot 2 adjusts the angle and height of the hands thereof, and removes a wafer from the wafer cassette and holds it under the influence of a vacuum by means of the hand for holding a clean wafer.

3. The transfer robot 2 adjusts the angle and height of the hands again while holding the wafer, and transfers the wafer to the turning-over machine 4.
4. The turning-over machine 4 actuates its chucks to hold the wafer which has been transferred by the transfer robot 2. When it is confirmed that the wafer is securely held, the turning-over machine 4 turns the wafer through 180° so that a surface of the wafer that is to be processed faces downward.
5. When it is confirmed that the turning-over machine 4 has turned the wafer through 180° accurately, the transfer robot 6 at the rearmost position adjusts the angle and height of the hands thereof. Then, the transfer robot 6 receives the wafer from the turning-over machine 4 by means of the hand for holding a clean wafer. At the same time, the chucks of the turning-over machine 4 are released.
6. The transfer robot 6 adjusts the angle and height of the hands again, and moves to the foremost position near the polishing chamber 10B. When it is confirmed that no wafer is present on the loading lift 20, the shutter 24 opens, and the wafer is transferred to the loading lift 20.
7. When it is confirmed that the wafer has been transferred to the loading lift 20, the loading lift 20 moves upward and actuates its chucks to hold the wafer holder 15 which is positioned above the loading lift 20. Thereafter, a stage on which the wafer is placed moves upward. When a backside of the wafer is brought into contact with a holding part of the wafer holder 15, the wafer holder 15 holds the wafer under the influence of a vacuum.
8. When it is confirmed that the wafer is securely held by the wafer holder 15, the wafer carrier 14 supporting the arms 16 is rotated through 120° in a clockwise direction, to thereby move the wafer holder 15 to a polishing position above the polishing table 12.
9. When it is confirmed that the wafer holder 15 has moved to the polishing position, the polishing table 12 and the wafer holder 15 rotate in the same direction at a predetermined speed, and a polishing liquid of a predetermined type is supplied from the polishing liquid nozzle 18 onto the polishing table 12 at a predetermined flow rate. Thereafter, the wafer holder 15 lowers and, when it is confirmed that the wafer holder 15 has reached the polishing table 12, a predetermined pressure is applied to the wafer holder 15. Thus, polishing is conducted for a predetermined period of time. While one wafer is polished, the next wafer to be polished is transferred to the loading lift 20 in the same manner as mentioned above. This wafer transferred onto the loading lift 20 is held under the influence of a vacuum by means of the wafer holder 15 which is positioned at a loading position above the loading lift 20.
10. After polishing, the polishing liquid nozzle 18 stops the supply of polishing liquid. The wafer carrier 14 supporting the arms 16 is rotated to a position where a half of the wafer holder 15 is removed from the polishing table 12, and the wafer holder 15 lifts the wafer under the influence of a vacuum.
11. When it is confirmed that the wafer is held under the influence of a vacuum by the wafer holder 15, the wafer carrier 14 supporting the arms 16 is rotated through 120° in the clockwise direction, thus moving the wafer holder 15 from the polishing position to an unloading position above the unloading lift 21. In this instance, the wafer holder 15 which has been located above the loading lift 20 while holding the wafer to be polished, moves to the polishing position in accordance with the rotation of the wafer carrier 14.
12. When it is confirmed that the wafer holder 15 is positioned above the unloading lift 21, the unloading lift 21 moves upward and actuates its chucks to hold the wafer holder 15. At the same time, the wafer holder 15 stops applying vacuum and blows air or nitrogen and pure water, to thereby release the wafer onto the unloading lift 21.
13. After the wafer is released onto the unloading lift 21, the unloading lift 21 lowers so that the hand of the transfer robot 9 reaches the unloading lift 21.
14. When it is confirmed that the wafer is present on the unloading lift 21, pure water is ejected from the rinsing nozzle 23 so as to clean the wafer holder 15 and the wafer.
15. After completion of cleaning of the wafer holder 15 and the wafer, the shutter 25 opens. The transfer robot 9 adjusts the angle and height of the hand thereof and receives the wafer from the unloading lift 21. During these steps, a wafer which has been transferred onto the loading lift 20 in the same manner as mentioned above is held by the wafer holder 15 under the influence of a vacuum at the loading position above the loading lift 20. On the other hand, the wafer which has been transferred by the wafer holder 15 to the polishing position above the polishing table 12 is subjected to polishing.
16. The third wafer is also transferred in the same manner as in steps 1 to 10. However, after step 10, the wafer holder 15 is rotated through 240° in a counterclockwise direction and is positioned above the unloading lift 21. The fifth wafer is transferred in the same manner as in steps 1 to 7 and rotated through 240° in the counterclockwise direction to a position above the polishing table 12. The transferring steps other than these steps of the third and fifth wafers are conducted through 120°-rotations in the clockwise direction.
17. The transfer robot 9 which has received the wafer from the unloading lift 21 adjusts the angle and height of the hand thereof and transfers the wafer to the cleaning machine 8. The cleaning machine 8 actuates its chucks to hold the wafer.
18. When it is confirmed that the wafer is securely held, the first-stage cleaning after polishing is conducted by the cleaning machine 8.
19. After completion of cleaning by the cleaning machine 8, the transfer robot 6 moves to the position for access to the cleaning machine 8. At the same time, the transfer robot 6 adjusts the angle and height of the hands thereof, and receives the wafer by means of the hand for holding a contaminated wafer.
20. The transfer robot 6 adjusts the angle and height of the hands again and transfers the wafer to the turning-over machine 5. The turning-over machine 5 actuates its chucks to hold the wafer.
21. When it is confirmed that the wafer is securely held by the turning-over machine 5, pure water is ejected from a pure water rising nozzle attached to the turning-over machine 5, to thereby prevent the wafer from becoming dry. The turning-over machine 5 turns the wafer through 180° so that the surface of the wafer that has been polished faces upward.

22. When it is confirmed that the turning-over machine 5 has turned the wafer through 180° accurately, the transfer robot 2 adjusts the angle and height of the hands thereof and receives the wafer from the turning-over machine 5 by means of the hand for holding a contaminated wafer. The chucks of the turning-over machine 5 are released.

23. The transfer robot 2 adjusts the angle and height of the hands again and transfers the wafer to the cleaning machine 3. The cleaning machine 3 actuates its chucks to hold the wafer.

24. When it is confirmed that the wafer is securely held, the second-stage cleaning after polishing is conducted by the cleaning machine 3. The cleaning machine 3 is provided with a spin-drying function. After cleaning, the wafer is dried by means of high speed rotation.

25. After completion of cleaning by the cleaning machine 3, the transfer robot 2 adjusts the angle and height of the hands, and receives the wafer from the cleaning machine 3 by means of the hand for holding a clean wafer.

26. The transfer robot 2 adjusts the angle and height of the hands again, and transfers the wafer to its previous position in the wafer cassette before processing.

Even-numbered wafers including the second wafer are transferred to the polishing table 13 in substantially the same manner as mentioned above. The wafer carrier 14 provided at a side of the polishing table 13 is rotated in a direction opposite to that of rotation of the wafer carrier 14 at a side of the polishing table 12 for polishing odd-numbered wafers. The wafer holder 15 for the polishing table 13 is moved in a direction opposite to that of movement of the wafer holder 15 for the polishing table 12 so that the even-numbered wafers are cleaned and returned to the wafer cassette in the same manner as mentioned above.

Figure 3:
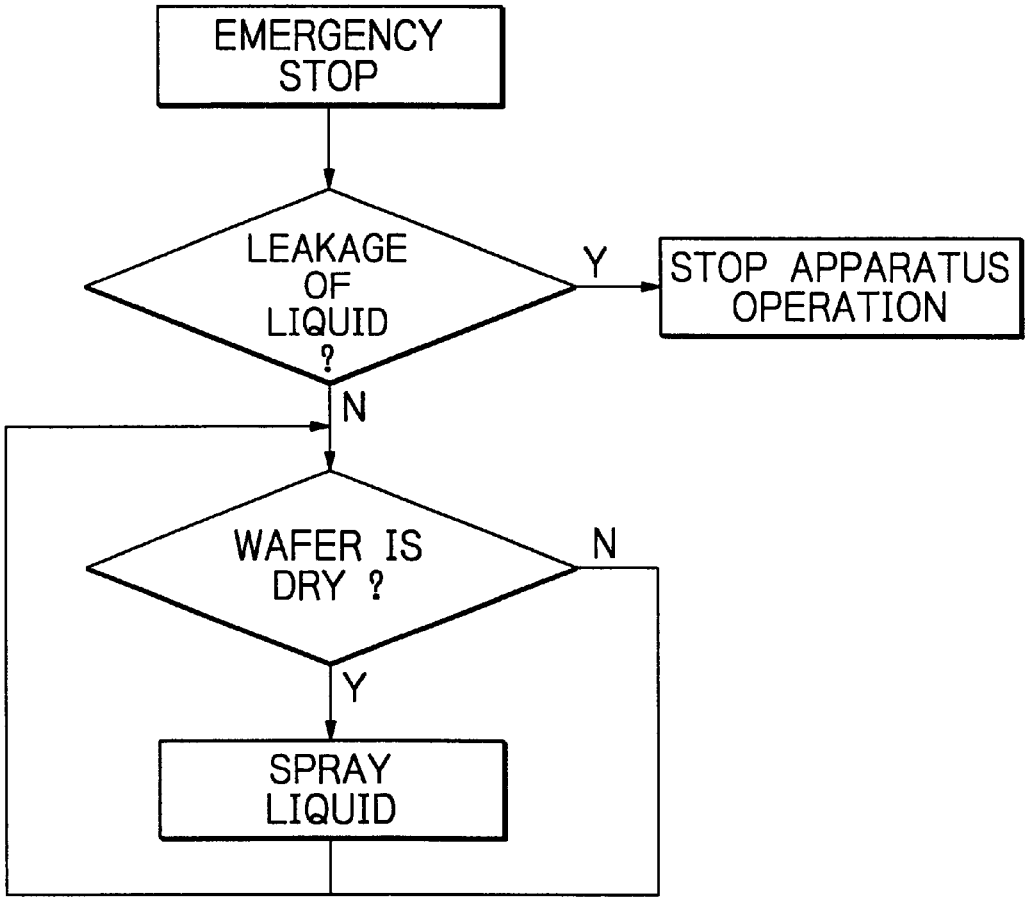
FIG. 3 shows a control flow chart with respect to a liquid spray nozzle in the apparatus of FIG. 1.

FIG. 3 shows a control flow chart of the liquid spray nozzle 22 provided in each of the loading lift 20 and the unloading lift 21. First, in the event of an emergency stop, it is determined whether a leakage of liquid is a cause of the emergency stop. If so, the apparatus is stopped. If a leakage of liquid is not a cause of the emergency stop, a degree of drying of the wafer which is held by the wafer holder 15 in a standby condition, is detected by a sensor such as a gloss sensor, a CCD or a chromatic sensor. If it is determined that the wafer is dry, a liquid is sprayed from the liquid spray nozzle 22 toward the wafer. This prevents the wafer in a standby condition from becoming dry thus avoiding the problem of dust.

Figure 4:
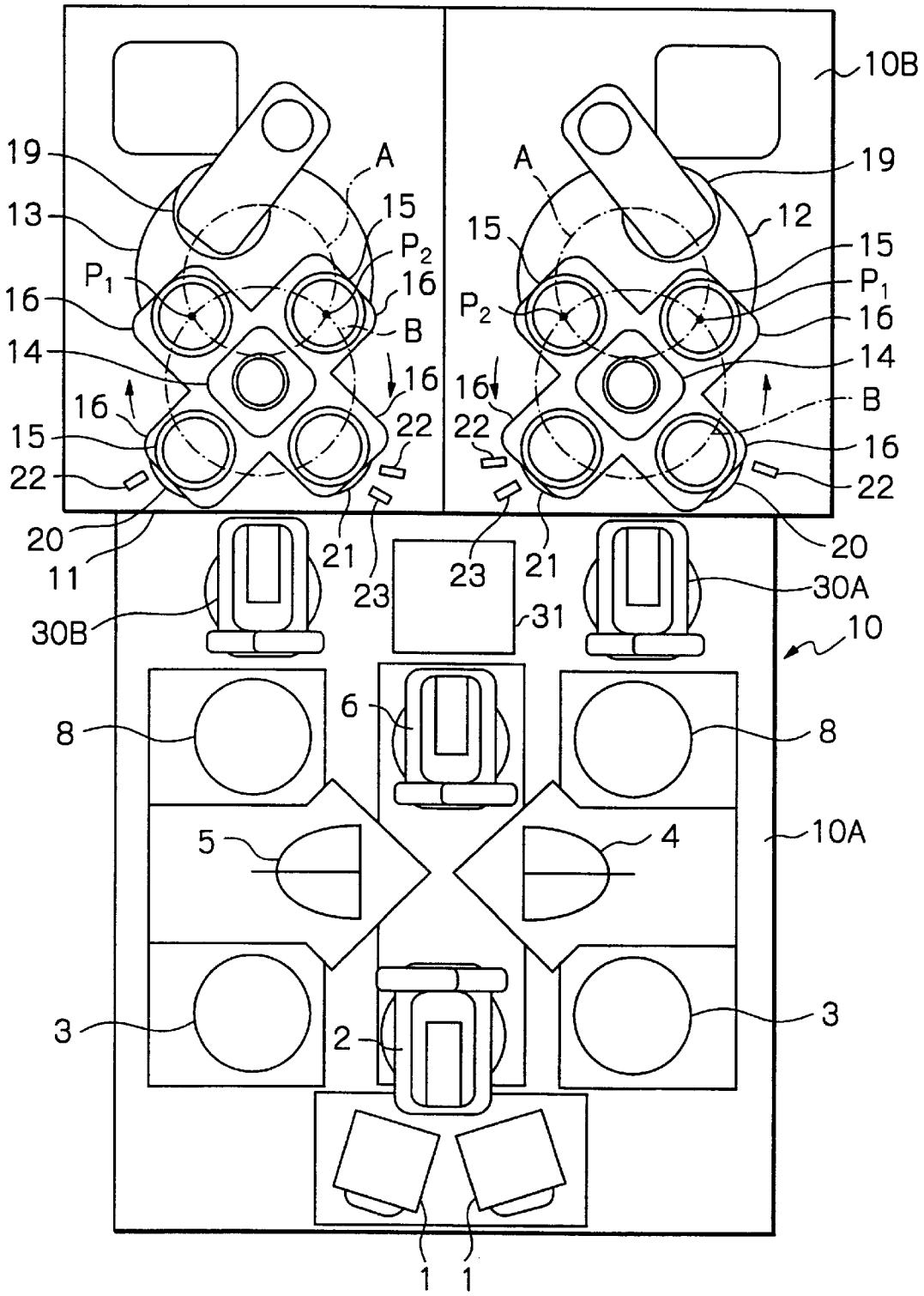
FIG. 4 is a plan view showing the arrangement of each part of a second embodiment of the polishing apparatus according to the present invention.

FIG. 4 is a plan view of a second embodiment of a polishing apparatus according to the present invention.

The polishing apparatus shown in FIG. 4 has the rotatable loading/unloading stages 1 for placing wafer cassettes thereon. Each wafer cassette is stocked with a large number of semiconductor wafers. The transfer robot 2 having two hands is disposed at a position where the hands are able to reach the wafer cassettes on the loading/unloading stages 1.

Of the two hands of the transfer robot 2, one hand holds a clean semiconductor wafer, and the other hand holds a contaminated wafer. The cleaning machines 3 for cleaning and drying a polished semiconductor wafer are disposed on either side of the transfer robot 2 respectively, within reach of the hands of the transfer robot 2. The turning-over machines 4 and 5 for turning over a semiconductor wafer are disposed within reach of the hands of the transfer robot 2. The turning-over machines 4 and 5 are positioned in rotationally symmetric relation to the loading/unloading stages 1, with respect to the center of rotation of the transfer robot 2.

The turning-over machine 4 has a chucking mechanism for chucking a semiconductor wafer and a turning-over mechanism for turning a semiconductor wafer upside down. The turning-over machine 4 handles only clean semiconductor wafers, while the turning-over machine 5 includes a rinsing mechanism for washing semiconductor wafers, in addition to a chucking mechanism and a turning-over mechanism. The turning-over machine 5 handles only contaminated semiconductor wafers.

The transfer robot 6 provided with two hands is positioned in symmetric relation to the transfer robot 2, as viewed along a line passing through the turning-over machines 4 and 5. The transfer robot 6 is disposed at a position where its hands are able to reach the turning-over machines 4 and 5. Of the two hands of the transfer robot 6, one hand is employed for holding clean semiconductor wafers, while the other hand holds contaminated wafers.

The cleaning machines 8 for cleaning a polished semiconductor wafer are disposed on either side of the transfer robot 6. These cleaning machines 8 are different from the cleaning machines 3 in terms of the cleaning operation conducted thereby.

Transfer robots 30A and 30B each provided with two hands are positioned on a side opposite the turning-over machines 4 and 5, with respect to a line passing through the centers of the cleaning machines 8. The transfer robots 30A and 30B are disposed at a position where their hands are able to reach the cleaning machines 8. Of the two hands of each of the transfer robots 30A and 30B, one hand is employed for holding clean semiconductor wafers, while the other hand holds contaminated wafers. A wafer mount 31 is provided between the transfer robots 30A and 30B. The wafer mount 31 comprises, for example, a dry station and a wet station which are vertically arranged. The wet station has a rinsing nozzle. When the wafer stands by on the wet station, pure water is sprayed over the wafer so as to prevent the wafer from becoming dry. The wafer may be cleaned by using a liquid other than pure water.

The entire polishing apparatus is housed in the housing 10 divided by the partition 11 into the cleaning chamber 10A and the polishing chamber 10B. The cleaning chamber 10A contains the transfer robots 30A and 30B, the wafer mount 31 and the other above-stated devices. The partition 11 is disposed near the transfer robots 30A and 30B.

The polishing tables 12 and 13 each comprising a turntable are provided in the polishing chamber 10B. The wafer carriers 14 are provided at a side of the polishing tables 12 and 13. The arms 16 extend radially relative to the axis of rotation of the wafer carrier 14. In this embodiment, the number of arms 16 is four. Each wafer carrier 14 supports the wafer holder 15 at a free end portion thereof so that the wafer holders 15 are positioned around a circle about the axis of the wafer carrier 14 and spaced apart from each other at equal angular distances, i.e., 90°. The wafer carrier 14 is operated to intermittently rotate, stopping after a rotation of 90° has been completed. Alternatively, the wafer carrier 14 may rotate through 180° in alternate directions, stopping after a rotation of 180° has been completed in either direction.

As shown in FIG. 2, the wafer holder 15 is suspended from the arm 16 through the rotatable shaft 17 and is able to access the polishing table 12 or 13. A pneumatic cylinder provided in the arm 16 is operated to urge a semiconductor wafer held on the wafer holder 15 against the polishing table under a desired load. The polishing liquid nozzle 18 for supplying a polishing liquid is disposed above the polishing table, so as to have an opening thereof positioned above a central portion of the polishing table. The dresser 19 is disposed for dressing the polishing table. The polishing table has a polishing cloth or abrasive plate fitted to the upper surface thereof to provide a polishing surface.

In FIG. 4, reference character A indicates a circle on which a substrate is expected to be subjected to an optimum polishing by the polishing table. Reference character B indicates a circle through which the wafer holders 15 pass during rotation thereof about the axis of the wafer carrier 14. A first polishing position $P_1$ and a second polishing position $P_2$ are defined as two intersecting positions between the circles A and B.

The loading lift 20 has a lifting mechanism and is vertically movable between a position where a semiconductor wafer is received from the transfer robot and a position where the loading lift 20 transfers the wafer to the wafer holder 15 positioned above the loading lift 20. The loading lift 20 has an automatic centering mechanism. An upward movement range of the loading lift 20 is determined such as to take account of any error in attachment of the wafer holder 15. The loading lift 20 is capable of transferring the wafer while holding the wafer holder 15. Further, the loading lift 20 includes the liquid spray nozzle 22. The liquid spray nozzle 22 sprays a liquid toward the wafer which is held by the wafer holder 15, to thereby prevent the wafer from becoming dry.

As in the case of the loading lift 20, the unloading lift 21 has a lifting mechanism, an automatic centering mechanism and a liquid spray nozzle 22. Further, the unloading lift 21 has the rinsing nozzle 23 for cleaning the wafer holder 15 after the wafer is released therefrom and the wafer released.

Opening portions are provided in the partition 11 between the transfer robots 30A and 30B and the lifts 20 and 21. Each opening portion is dimensioned so as to allow passage of the wafer therethrough. Shutters are provided in the opening portions.

An operation of the entire polishing apparatus arranged as stated above will be described below.

Semiconductor wafers to be polished are placed in the wafer cassettes. The wafer cassettes are placed on the loading/unloading stages 1. Following input of data corresponding to processing conditions, the apparatus starts an automated operation as stated below. In the polishing apparatus of the present invention, various polishing operations are possible. First, parallel operation (1) is described below. In this operation, odd-numbered wafers counted from the uppermost slot of the wafer cassette are subjected to polishing on the polishing table 12 and even-numbered wafers are polished on the polishing table 13. Hereinbelow, the steps for polishing by parallel operation (1) are explained.

Figures 5A, 5B, 5C, 5D, 5E:
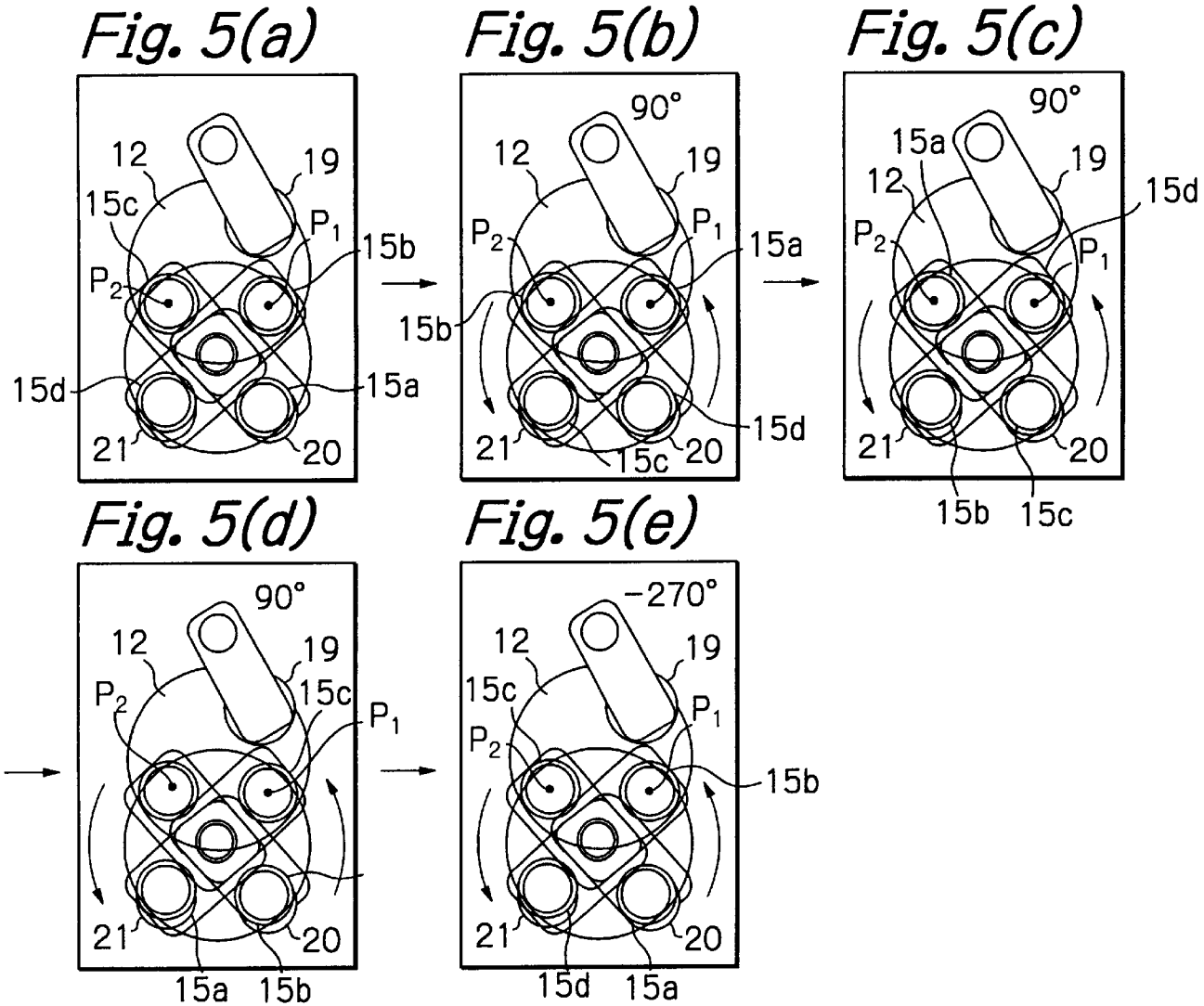
FIGS. 5(*a*) to 5(*e*) show an example of a movement of a wafer holder in respective steps for polishing a semiconductor wafer by using the polishing apparatus of FIG. 4.

FIGS. 5(*a*) to 5(*e*) show a movement of the wafer holder 15 in respective steps of parallel operation (1) conducted by using the polishing apparatus of FIG. 4. In an initial position of FIG. 5(*a*), a wafer holder 15*a* is positioned above the loading lift 20. A wafer holder 15*b* and a wafer holder 15*c* are positioned at the first polishing position $P_1$ and the second polishing position $P_2$, respectively. A wafer holder 15*d* is positioned above the unloading lift 21.

A. Parallel Operation (1)

1. The angle of the loading/unloading stage 1 is adjusted so that the hands of the transfer robot 2 can access the wafer cassette.
2. The transfer robot 2 adjusts the angle and height of the hands thereof, and removes a wafer from the wafer cassette and holds it under the influence of a vacuum by means of the hand for holding a clean wafer.
3. The transfer robot 2 adjusts the angle and height of the hands again while holding the wafer, and transfers the wafer to the turning-over machine 4.
4. The turning-over machine 4 actuates its chucks to hold the wafer which has been transferred by the transfer robot 2. When it is confirmed that the wafer is securely held, the turning-over machine 4 turns the wafer through 180° so that a surface of the wafer that is to be processed faces downward.
5. When it is confirmed that the turning-over machine 4 has turned the wafer through 180° accurately, the transfer robot 6 adjusts the angle and height of the hands thereof. Then, the transfer robot 6 receives the wafer from the turning-over machine 4 by means of the hand for holding a clean wafer. At the same time, the chucks of the turning-over machine 4 are released.
6. The transfer robot 6 adjusts the angle and height of the hands again, and transfers the wafer to the dry station or wet station of the wafer mount 31.
7. When it is confirmed that the wafer has been transferred to the wafer mount 31, the transfer robot 30A adjusts the angle and height of the hands thereof and receives the wafer which has been transferred to the dry station or wet station of the wafer mount 31 by means of the hand for holding a clean wafer. The wafer is then transferred to the loading lift 20.
8. When it is confirmed that the wafer has been transferred to the loading lift 20, the loading lift 20 moves upward and, as shown in FIG. 5(*a*), the loading lift 20 actuates its chucks to hold the wafer holder 15*a* which is positioned above the loading lift 20. Thereafter, a stage on which the wafer is placed moves upward. When a backside of the wafer is brought into contact with a holding part of the wafer holder 15*a,* the wafer holder 15*a* holds the wafer under the influence of a vacuum.
9. When it is confirmed that the wafer is securely held by the wafer holder 15*a,* the wafer carrier 14 supporting the arms 16 is rotated through 90° in a counterclockwise direction, to thereby move the wafer holder 15*a* to the first polishing position $P_1$ above the polishing table 12, as shown in FIG. 5(*b*).
10. When it is confirmed that the wafer holder 15*a* has moved to the first polishing position $P_1$, the polishing table 12 and the wafer holder 15*a* rotate in the same direction at a predetermined speed, and a polishing liquid of a predetermined type is supplied from the polishing liquid nozzle 18 onto the polishing table 12 at a predetermined flow rate. Thereafter, the wafer holder 15*a* moves downward and, when it is confirmed that the wafer holder 15*a* has reached the polishing table 12, a predetermined pressure is applied to the wafer holder 15*a*. Thus, polishing is conducted for a predetermined period of time. Thereafter, if desired, the pressure applied to the wafer holder 15*a* may be reduced and polishing may be conducted by using water. While one wafer is polished, the next wafer to be polished is transferred to the loading lift 20 in the same manner as mentioned above. This wafer transferred onto the loading lift 20 is held under the influence of a vacuum by means of the wafer holder 15*d* which is positioned at a loading position above the loading lift 20.
11. After completion of polishing at the first polishing position $P_1$, the wafer carrier 14 supporting the arms 16 rotates through 90° in the counterclockwise direction and, as shown in FIG. 5(*c*), the wafer holder 15*a* moves to the second polishing position $P_2$ above the polishing table 12. In this instance, when the wafer at the first polishing position $P_1$ is polished by using water, the wafer is swung to the second polishing position $P_2$ while being polished. At the second polishing position $P_2$, polishing is conducted in substantially the same manner as in step 10. It is preferred that the time for polishing at the second polishing position $P_2$ be equal to that for polishing at the first polishing position $P_1$, from the viewpoint of efficient polishing. The wafer which has been transferred onto the loading lift 20 in the same manner as mentioned above is held under the influence of a vacuum by the wafer holder 15*c* at the loading position above the loading lift 20. On the other hand, the wafer which has been held by the wafer holder 15*d* and transferred to the first polishing position $P_1$ is subjected to polishing.

12. After completion of polishing at the second polishing position $P_2$, the wafer holder 15*a* is moved to a position where a half of the wafer holder 15*a* is removed from the polishing table 12. Thereafter, the wafer holder 15*a* is lifted and separated from the polishing table 12.

13. When it is confirmed that the wafer holder 15*a* has separated from the polishing table 12, the wafer carrier 14 supporting the arms 16 is rotated through 90° in a counterclockwise direction and, as shown in FIG. 5(*d*), the wafer holder 15*a* moves to a position above the unloading lift 21.

14. When it is confirmed that the wafer holder 15*a* is positioned above the unloading lift 21, the unloading lift 21 moves upward and actuates its chucks to hold the wafer holder 15*a*. At the same time, the wafer holder 15*a* stops applying vacuum and blows air or nitrogen and pure water, to thereby release the wafer onto the unloading lift 21.

15. After the wafer has been released from the wafer holder 15*a,* the unloading lift 21 lowers so that the transfer robot 30A can access the unloading lift 21.

16. When it is confirmed that the wafer is present on the unloading lift 21, pure water is ejected from the rinsing nozzle 23 so as to clean the wafer holder 15*a* and the wafer.

17. After completion of cleaning of the wafer holder 15*a* and the wafer, the shutter opens. The transfer robot 30A adjusts the angle and height of the hands thereof and receives the wafer from the unloading lift 21 by means of the hand for holding a contaminated wafer. In this instance, the wafer which has been transferred onto the loading lift 20 in the same manner as mentioned above is held under the influence of a vacuum by the wafer holder 15*b* at the loading position above the loading lift 20. On the other hand, the wafer which has been transferred by the wafer holder 15*d* to the second polishing position $P_2$ is subjected to polishing. The wafer which has been transferred by the wafer holder 15*c* to the first polishing position $P_1$ is subjected to polishing.

18. After these steps, the wafer carrier 14 supporting the arms 16 rotates through 270° in a clockwise direction and, as shown in FIG. 5(*e*), returns to the initial position shown in FIG. 5(*a*).

19. The transfer robot 30A which has received the wafer from the unloading lift 21 adjusts the angle and height of the hands thereof and transfers the wafer to the cleaning machine 8. The cleaning machine 8 actuates its chucks to hold the wafer.

20. When it is confirmed that the wafer is securely held, the first-stage cleaning after polishing is conducted by the cleaning machine 8. The cleaning machine 8 is capable of cleaning both sides of a wafer simultaneously and can conduct chemical liquid cleaning such as DHF, if desired.

21. After completion of cleaning by the cleaning machine 8, the transfer robot 6 adjusts the angle and height of the hands, and receives the wafer by means of the hand for holding a contaminated wafer.

22. The transfer robot 6 adjusts the angle and height of the hands again and transfers the wafer to the turning-over machine 5. The turning-over machine 5 actuates its chucks to hold the wafer.

23. When it is confirmed that the wafer is securely held by the turning-over machine 5, pure water is ejected from a pure water rising nozzle attached to the turning-over machine 5, to thereby prevent the wafer from becoming dry. The turning-over machine 5 turns the wafer through 180° so that the surface of the wafer that has been polished faces upward.

24. When it is confirmed that the turning-over machine 5 has turned the wafer through 180° accurately, the transfer robot 2 adjusts the angle and height of the hands and receives the wafer from the turning-over machine 5 by means of the hand for holding a contaminated wafer. The chucks of the turning-over machine 5 are released.

25. The transfer robot 2 adjusts the angle and height of the hands again and transfers the wafer to the cleaning machine 3. The cleaning machine 3 actuates its chucks to hold the wafer.

26. When it is confirmed that the wafer is securely held, the second-stage cleaning after polishing is conducted by the cleaning machine 3. The cleaning machine 3 may conduct contact-type cleaning in which a pencil-type cleaning member, for example, is brought into contact with the wafer or non-contact cleaning in which, for example, a jet of cleaning liquid accompanied by megasonic vibration and/or cavitation is directed to the wafer. The type of cleaning is selected in conformity with the preceding and/or subsequent steps and the kind of film formed on the wafer. The cleaning machine 3 is provided with a spin-drying function. After cleaning, the wafer is dried by means of high-speed rotation.

27. After completion of cleaning by the cleaning machine 3, the transfer robot 2 adjusts the angle and height of the hands, and receives the wafer from the cleaning machine 3 by means of the hand for holding a clean wafer.

28. The transfer robot 2 adjusts the angle and height of the hands again, and transfers the wafer to its previous position in the wafer cassette before processing. Even-numbered wafers including the second wafer are transferred to the polishing table 13 in substantially the same manner as mentioned above. The wafer carrier 14 provided at a side of the polishing table 13 is rotated in a direction opposite to that of rotation of the wafer carrier 14 at a side of the polishing table 12 for polishing odd-numbered wafers. The wafer holder 15 for the polishing table 13 is moved in a direction opposite to that of movement of the wafer holder 15 for the polishing table 12 so that even-numbered wafers are cleaned and returned to the wafer cassette in the same manner as mentioned above.

Next, parallel operation (2) is described below. In this operation, odd-numbered wafers counted from the uppermost slot of the wafer cassette are subjected to polishing on the polishing table 12, while even-numbered wafers are polished on the polishing table 13. In parallel operation (2), the route for transferring wafers in the cleaning chamber 10A is the same as that in parallel operation (1). Therefore, in the following explanation, only the transfer of the wafer between the cleaning chamber 10A and the polishing chamber 10B and the operation in the polishing chamber 10B are explained.

B. Parallel Operation (2)

1. A wafer which has been transferred onto the wafer mount 31 is transferred to the loading lift 20 by the transfer robot 30A. Another wafer is transferred to the unloading lift 21.
2. The wafer on the loading lift 20 and the wafer on the unloading lift 21 are held under the influence of a vacuum by means of the wafer holders 15 positioned thereabove.
3. The wafer carrier 14 supporting the arms 16 rotates through 180° in, for example, the counterclockwise direction (normal direction), so that the wafers held by the wafer holders 15 are transferred to the first polishing position $P_1$ and the second polishing position $P_2$.
4. The wafer holders 15 above the first polishing position $P_1$ and the second polishing position $P_2$ move downward, and polishing is started. When successive wafers are polished in the same way, the wafers are supplied to the loading lift 20 and unloading lift 21 and held by wafer holders 15 positioned above the loading and unloading lifts 20 and 21 during the polishing operation at the first and second polishing positions $P_1$ and $P_2$.
5. After polishing, the wafer holders 15 move upward, and the wafer carrier 14 supporting the arms 16 rotates through 180° in the opposite direction, for example, the clockwise direction (reverse rotation), so that the wafers held by the wafer holders 15 are transferred to the positions above the loading lift 20 and the position the unloading lift 21.
6. The wafers held by the wafer holders 15 above the loading lift 20 and the wafer above the unloading lift 21 are released onto the loading lift 20 and the unloading lift 21 at the same time. Simultaneously, the wafer holders 15 positioned at the first and second polishing stations $P_1$ and $P_2$ move downward and subject the wafer held by them to polishing.
7. At the loading lift 20 and the unloading lift 21, the wafer holders 15 and the wafers are cleaned.
8. The wafers are removed from the loading lift 20 and the unloading lift 21 by the transfer robot 30A.
9. The above steps 1 to 8 are repeated.

Further, serial operations (1) and (2) are explained below. In these operations, a single wafer is continuously polished on the two polishing tables 12 and 13. In the following explanation, a unit including the polishing table 12 is called a first polishing unit and a unit including the polishing table 13 is called a second polishing unit. Only the route for transferring the wafer is indicated.

C. Serial Operation (1)

the cassette→the transfer robot→the turning-over machine→the transfer robot 6→the wafer mount 31 (dry station)→the transfer robot 30A→the first polishing unit→the transfer robot 30A→the wafer mount 31 (wet station)→the transfer robot 30B→the second polishing unit→the transfer robot 30B→the wafer mount 31 (wet station)→the transfer robot 6→the cleaning machine 8→the transfer robot 6→the turning-over machine 5→the transfer robot 2→the cleaning machine 3→the transfer robot 2→the cassette.

D. Serial Operation (2)

the cassette→the transfer robot 2→the turning-over machine 4→the transfer robot 6→the wafer mount 31 (dry station)→the transfer robot 30A→the first. polishing unit→the transfer robot 30A→the cleaning machine 8→the transfer robot 6→the wafer mount 31 (wet station)→the transfer robot 30B→the second polishing unit→the transfer robot 30B→the wafer mount 31 (wet station)→the transfer robot 6→the cleaning machine 8→the transfer robot 6→the turning-over machine 5→the transfer robot 2→the cleaning machine 3→the transfer robot 2→the cassette.

It should be noted that in the above-mentioned embodiments, a turntable is used as the polishing table. However, a table capable of performing a circular orbital motion or a reciprocating motion may be used. In the second embodiment, when use is made of a table capable of performing a circular orbital motion or a reciprocating motion, this table is provided at each of the first polishing position and the second polishing position. The control flow chart shown in FIG. 3 is also effective in the second embodiment in preventing a wafer in a standby condition from becoming dry.

As has been described above, in the present invention, the transfer of a wafer to be polished to a wafer holder and the transfer of a polished wafer from a wafer holder can be conducted separately by a loading lift and an unloading lift and conducted simultaneously with polishing. Therefore, the number of wafers processed per unit time (throughput) can be remarkably increased.

What is claimed is:

1. A polishing apparatus comprising:

a polishing table having a polishing surface;

a substrate carrier having an axis about which the substrate carrier is rotatable, the substrate carrier including a plurality of substrate holders positioned around a circle about the axis of the substrate carrier and spaced apart from each other at equal angular distances, with each of said substrate holders being adapted to hold a substrate and bring it into contact with the polishing surface;

a substrate loading device laterally spaced apart from the polishing table, in which device a substrate is picked up by one of the substrate holders which is positioned at the substrate loading device; and a substrate unloading device laterally spaced apart from the polishing table, in which device one of the substrate holders which is positioned at the substrate unloading device releases a wafer onto the unloading device;

the substrate carrier being indexably rotated about the stated axis in such a manner that one of the substrate holders is selectively positioned at the loading device, while another substrate holder is positioned at the unloading device and at least one of the other substrate holders is positioned over the polishing surface.

2. A polishing apparatus as set forth in claim 1, wherein the substrate carrier comprises a plurality of arms extending radially relative to the stated axis and each of the arms is provided with the substrate holder.

3. A polishing apparatus as set forth in claim 1, wherein the polishing table comprises a turntable rotatable about a vertical axis and having an upper surface on which the polishing surface is provided, the loading device includes a loading lift movable between a lower position where the loading lift receives a substrate supplied from the outside and an upper position where the loading lift transfers the substrate to the substrate holder positioned over the loading device, the unloading device includes an unloading lift movable between an upper position where the unloading lift receives a substrate released from the substrate holder positioned over the unloading device and a lower position where the substrate is taken up from the unloading device.

4. A polishing apparatus as set forth in claim 1, wherein the number of the substrate holders is three, and the substrate carrier is indexably rotated about the stated axis in such a manner that one of the substrate holders is selectively positioned at the loading device, while another substrate holder is positioned at the unloading device and the other substrate holder is positioned over the polishing surface.

5. A polishing apparatus as set forth in claim 1, wherein the number of the substrate holders is four, and the substrate carrier is indexably rotated about the stated axis in such a manner that one of the substrate holders is selectively positioned at the loading device, while another substrate holder is positioned at the unloading device and the other two substrate holders are positioned over the polishing surface.

6. A polishing apparatus as set forth in claim 5, wherein the polishing table comprises a turntable having an axis about which the turntable is rotated, and, while the stated one of the substrate holders is positioned at the loading device, the stated other two substrate holders are located at first and second polishing positions, respectively, which are defined on the polishing surface as two intersecting positions between a circle about the axis of the polishing surface, on which circle a substrate is expected to be subjected to an optimum polishing, and a circle along which the substrates held by the substrate holders are rotated about the axis of the substrate holder.

7. A polishing apparatus as set forth in claim 1, further including:

a loading/unloading station where substrates to be polished are supplied and substrates which have been subjected to polishing are taken out;

a substrate transfer device provided between the loading/unloading station and the loading and unloading devices so that the transfer device receives substrates to be polished from the loading/unloading station and transfers them to the loading device and receives substrates which have been polished and positioned at the unloading device and transfers them to the loading/unloading station.

8. A polishing apparatus as set forth in claim 7, further including a cleaning apparatus provided between the loading/unloading station and the loading and unloading devices so that the substrate transfer device transfers substrates which have been polished are transferred to the cleaning apparatus to be cleaned before transferring the same to the loading/unloading station.

9. A polishing apparatus as set forth in claim 8, wherein there are provided a pair of polishing stations each comprising the polishing table, the substrate carrier, the substrate loading device and the substrate unloading device, and the pair of polishing stations are positioned in parallel with the substrate transfer device so that the transfer device cooperates with the loading and unloading devices of the respective polishing stations in the manner as stated.

10. A polishing apparatus as set forth in claim 6, wherein there are provided a pair of polishing stations each comprising the polishing table, the substrate carrier, the substrate loading device and the substrate unloading device, and the pair of polishing stations are positioned in parallel with the substrate transfer device so that the transfer device cooperates with the loading and unloading devices of the respective polishing stations in the manner as stated.

11. A polishing apparatus as set forth in claim 1, wherein the polishing table is movable in such a manner that the polishing surface is moved reciprocally.

12. A polishing apparatus as set forth in claim 1, wherein polishing table is movable in such a manner that the polishing surface performs a circular orbital motion.

13. A polishing apparatus as set forth in claim 1, wherein the substrate loading device is adapted to receive a wafer which has been polished and released from the substrate holder positioned at the substrate loading device.

14. A polishing apparatus as set forth in claim 13, wherein the substrate unloading device is adapted to receive a substrate which has not been subjected to polishing by the polishing table and transfer the substrate to one of the substrate holders positioned at the substrate unloading device.

15. A polishing apparatus as set forth in claim 1, wherein the substrate unloading device is adapted to receive a substrate which has not been subjected to polishing by the polishing table and transfer the substrate to one of the substrate holders positioned at the substrate unloading device.

16. A polishing apparatus as set forth in claim 1, wherein the unloading device is provided with a rinsing nozzle for supplying a rinsing liquid to a substrate which has been polished by the polishing table and transferred from the substrate holder to the unloading device and the substrate holder which released the substrate.

17. A polishing apparatus as set forth in claim 1, further comprising a liquid spray nozzle for supplying a liquid spray to a substrate held by the substrate holder positioned at the loading device.

18. A polishing apparatus as set forth in claim 17, further comprising a liquid spray nozzle for supplying a liquid spray to the substrate held by the substrate holder positioned at the unloading device.

* * * * *